US012161906B2

(12) United States Patent
Nezzacapo

(10) Patent No.: US 12,161,906 B2
(45) Date of Patent: Dec. 10, 2024

(54) EXERCISE BAR

(71) Applicant: Carmen Nezzacapo, Erie, PA (US)

(72) Inventor: Carmen Nezzacapo, Erie, PA (US)

( * ) Notice: Subject to any disclaimer, the term of this patent is extended or adjusted under 35 U.S.C. 154(b) by 79 days.

(21) Appl. No.: 18/068,283

(22) Filed: Dec. 19, 2022

(65) Prior Publication Data

US 2024/0198164 A1 Jun. 20, 2024

(51) Int. Cl.
*A63B 21/072* (2006.01)

(52) U.S. Cl.
CPC ..... *A63B 21/0724* (2013.01)

(58) Field of Classification Search
CPC ..... A63B 21/072; A63B 21/0722; A63B 21/0724; A63B 21/0726; A63B 21/0728; A63B 21/075; A63B 21/078; A63B 21/0783
See application file for complete search history.

(56) References Cited

U.S. PATENT DOCUMENTS

| | | | | | |
|---|---|---|---|---|---|
| 2,722,419 | A * | 11/1955 | Tarapczynski | A63B 21/0724 | 482/106 |
| D290,485 | S * | 6/1987 | Suponitsky | D21/679 | |
| 4,832,334 | A * | 5/1989 | Mullen | A63B 21/078 | 482/106 |
| 6,010,439 | A * | 1/2000 | Bullard, Jr. | A63B 21/4029 | 482/106 |
| 6,676,575 | B1 * | 1/2004 | Mayo | A63B 23/0211 | 482/148 |
| 9,254,410 | B1 * | 2/2016 | Mirza | A63B 23/12 | |
| 11,324,992 | B2 * | 5/2022 | Wu | A63B 1/00 | |
| 11,801,411 | B2 * | 10/2023 | Holovko | A63B 21/068 | |
| 2013/0196830 | A1 * | 8/2013 | Pfitzer | A63B 21/0603 | 482/110 |

* cited by examiner

*Primary Examiner* — Joshua Lee
(74) *Attorney, Agent, or Firm* — Jonathan M. D'Silva; MMI Intellectual Property

(57) ABSTRACT

An exercise bar comprising a pair of axially aligned straight ends for holding weights. An outer pair of curved grips extends inward from said straight ends, and an inner pair of curved grips extending inward from said outer pair of curved grips such that a first pair of parallel grips are formed that are generally perpendicular to said straight ends. A central curved section joins said inner pair of curved grips such that a second pair of parallel grips are formed that are generally perpendicular to said straight ends.

12 Claims, 10 Drawing Sheets

EXERCISE BAR

BACKGROUND

This disclosure relates to the field of exercise equipment, and more particularly to the field of weightlifting barbells. Traditional barbells consist of a pair of weight supporting ends that are joined by a length of straight bar. Standard straight barbells are optimal for certain chest, leg, and back exercises, but are limited in use and are known to stress a user's wrists, rotator cuffs, and elbows when used for certain arm and shoulder exercises. When used for arm curls, the straight grips limit a user's range of motion and prevents proper form, leading to stress on the user's joints.

Prior art exercise bars utilize an angled gripping section of bar to reduce stress on the user's joints and allow proper range of motion when performing arm exercises. However, these bars have a fixed grip angle that offers limited gripping options. What is presented is an exercise bar having a plurality of curved sections that form a plurality of gripping options and angles which increase the utility, comfort, and range of motion over traditional barbells.

SUMMARY

What is presented is an exercise bar comprising a pair of aligned straight ends for holding weights that are spaced apart along an axis. An outer pair of curved grips extends inward from said straight ends, and an inner pair of curved grips extends inward from said outer pair of curved grips such that a first pair of parallel grips are formed that are generally perpendicular to said straight ends. A central curved section joins said inner pair of curved grips such that a second pair of parallel grips are formed that are generally perpendicular to said straight ends.

The outer pair of curved grips and the central curved section are oriented above the axis. The inner pair of curved grips are oriented below the axis opposite form the outer pair of curved grips and the central curved section. Weights may be added to the straight ends and may be secured against an abutment zone by clips. Each of the grips may be given a knurled pattern or covered with a rubber sleeve for improved grip. The exercise bar is formed from one continuous section of bar. The central curved section may be sized to accommodate a user's head and neck, while the inner and outer pair of curved grips are sized and positioned to provide optimum gripping positions and angles for a user.

Those skilled in the art will realize that this invention is capable of embodiments that are different from those shown and that details of the apparatus and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
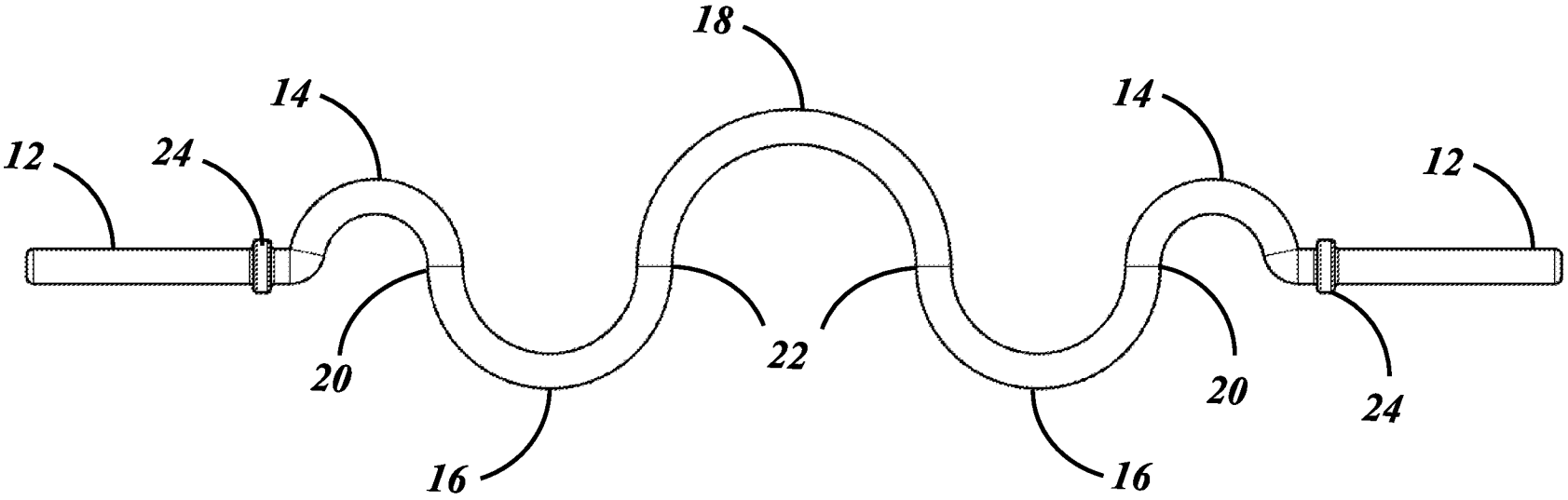
FIG. 1 is an elevation view of an exercise bar according to the disclosure.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

Figure 2:
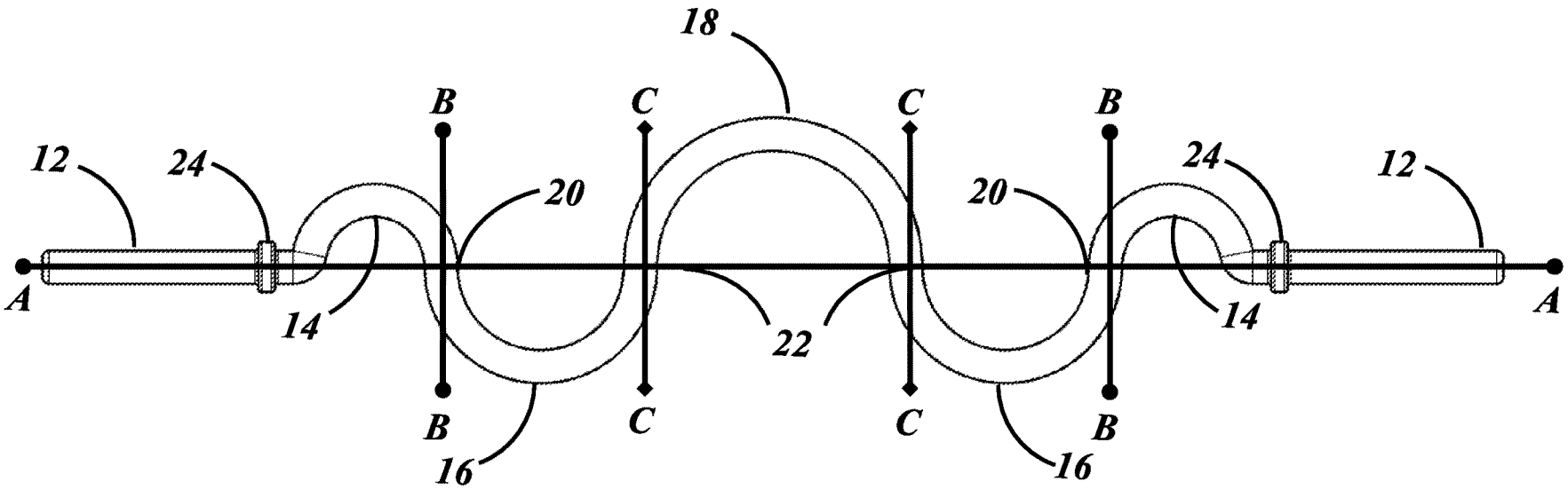
FIG. 2 is an elevation view of the exercise bar of FIG. 1 showing the axes of the first and second pair of parallel grips with respect to the axial alignment of the straight ends.
Figure 3:
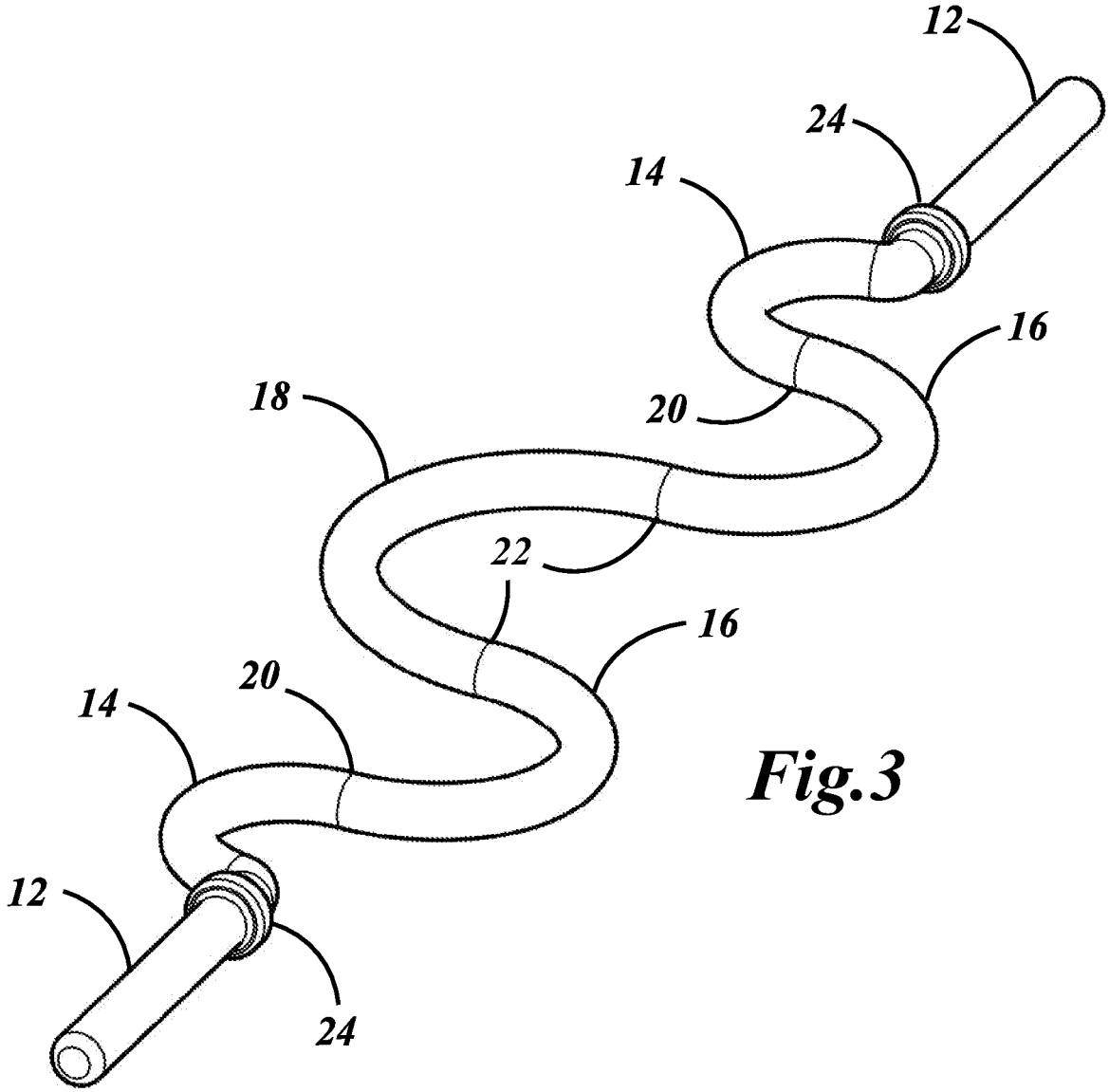
FIG. 3 is a perspective view of the exercise bar of FIG. 1.

As shown in FIGS. 1-3, the exercise bar 10 comprises a pair of axially aligned straight ends 12 that are spaced apart about an Axis A:A. An outer pair of curved grips 14 extend inwardly towards each other from the pair of straight ends 12 and are oriented above the Axis A:A. An inner pair of curved grips 16 extends inwardly towards each other from the outer pair of curved grips 14 and are oriented below the Axis A:A opposite from the outer pair of curved grips 14. A central curved section 18 joins the inner pair of curved grips 16 to form the continuous exercise bar 10.

A first pair of parallel grips 20 is formed at the area where the inner pair of curved grips 16 stem from the outer curved grips 14. The first pair of parallel grips 20 is generally perpendicular to the straight ends 12, providing a gripping axis B:B that is perpendicular to axis A:A. A second pair of parallel grips 22 is formed at the area where the central curved section 18 joins the inner curved grips 16. The second pair of parallel grips 22 is generally perpendicular to the straight ends 12, providing a gripping axis C:C that is perpendicular to axis A:A. As shown in FIG. 2, each of the curved sections of the exercise bar 10 begins and terminates at the Axis A:A and each consecutive curved section is oppositely oriented to form the first and second pair of parallel grips 20 and 22. The orientation of the curved sections 14, 16, and 18 ensures that the center lines of the inner and outer pairs of parallel grips 20 and 22 are located on the Axis A:A for balanced gripping of the exercise bar 10.

Figure 3A:
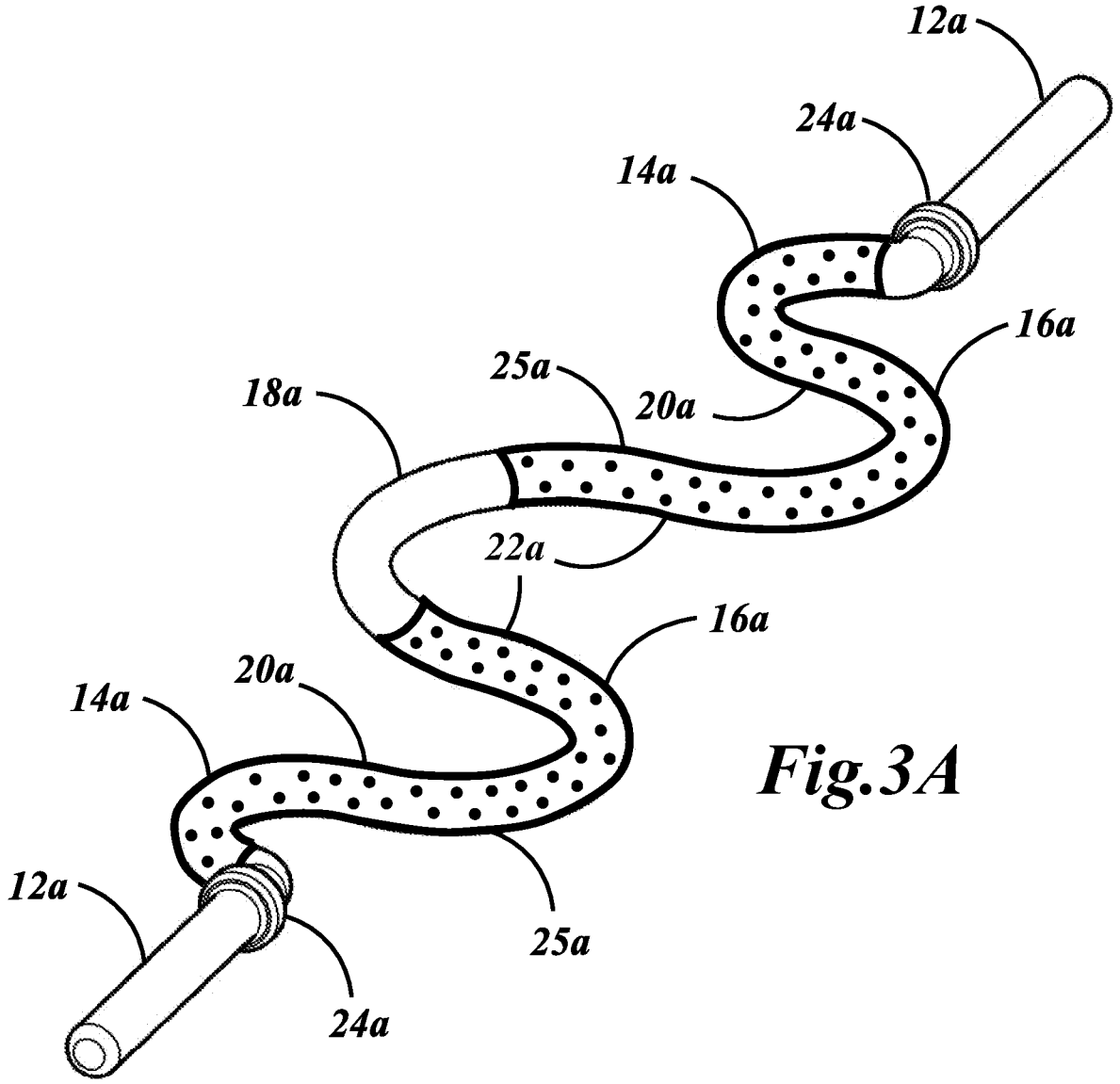
FIG. 3A is a perspective view of another embodiment of the exercise bar.
Figure 3B:
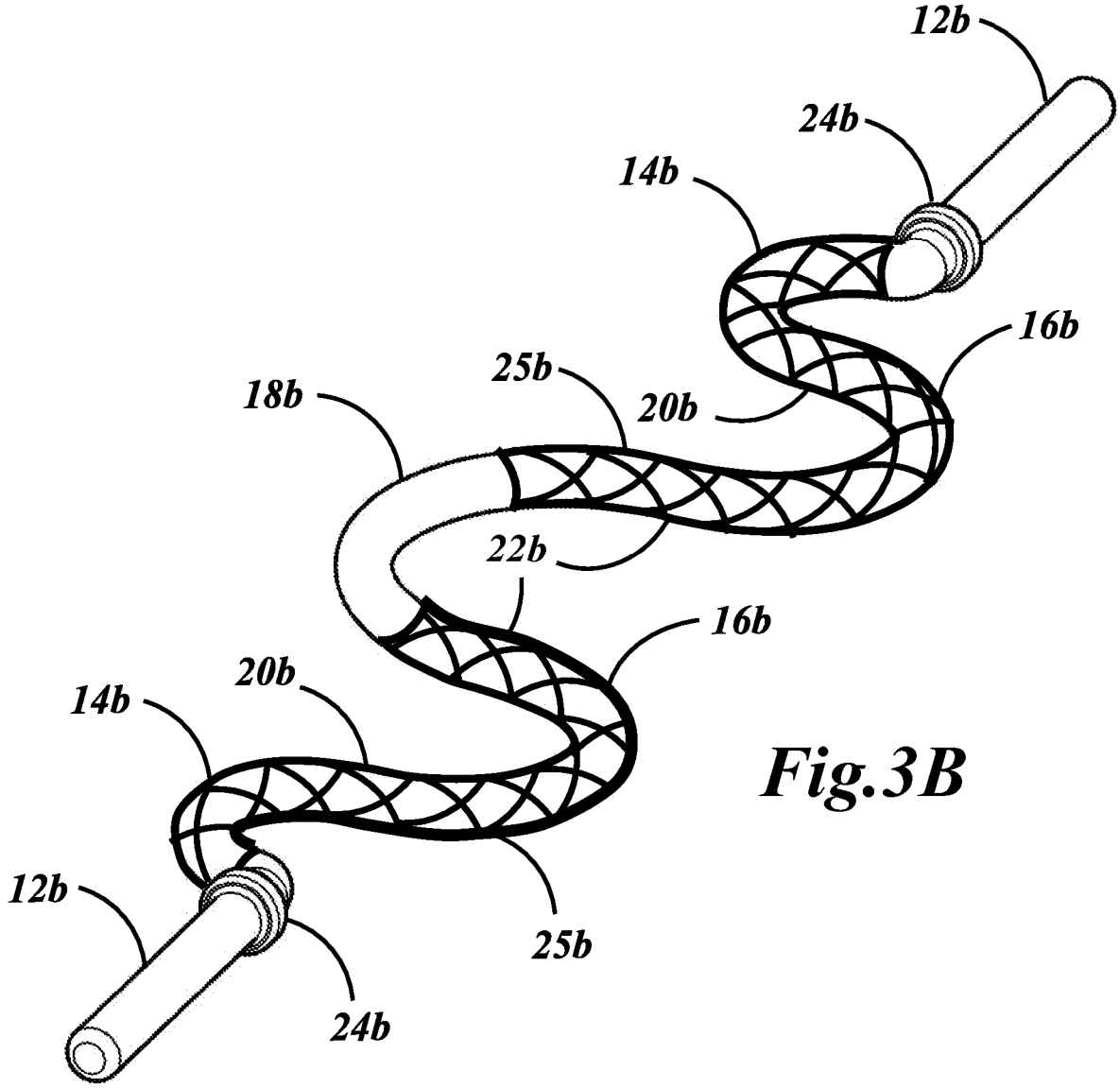
FIG. 3B is a perspective view of another embodiment of the exercise bar.

Preferably, the exercise bar 10 is formed from one continuous section of straight bar. The outer curved grips 14, the inner pair of curved grips 16, the center curved section 18 are formed by subjecting the bar to a bending operation. Preferably, the bar is made of cold rolled steel and is coated with a protective plating for corrosion resistance. In some embodiments, as shown for example in FIG. 3A, the outer curved grips 14*a*, the inner pair of curved grips 16*a*, and the first and second pair of parallel grips 20*a*, 22*a* may be fitted with rubber sleeves 25*a* to improve a user's grip on the exercise bar 10*a*. In other embodiments, as shown for example, in FIG. 3B, the exercise bar 10*b* has an outer pair of curved grips 14*b*, an inner pair of curved grips 16*b*, and a first and second pair of parallel grips 20*b* and 22*b* that may be fitted with a knurling pattern 25*b* to improve a user's grip on the exercise bar 10*b*.

Figure 4:
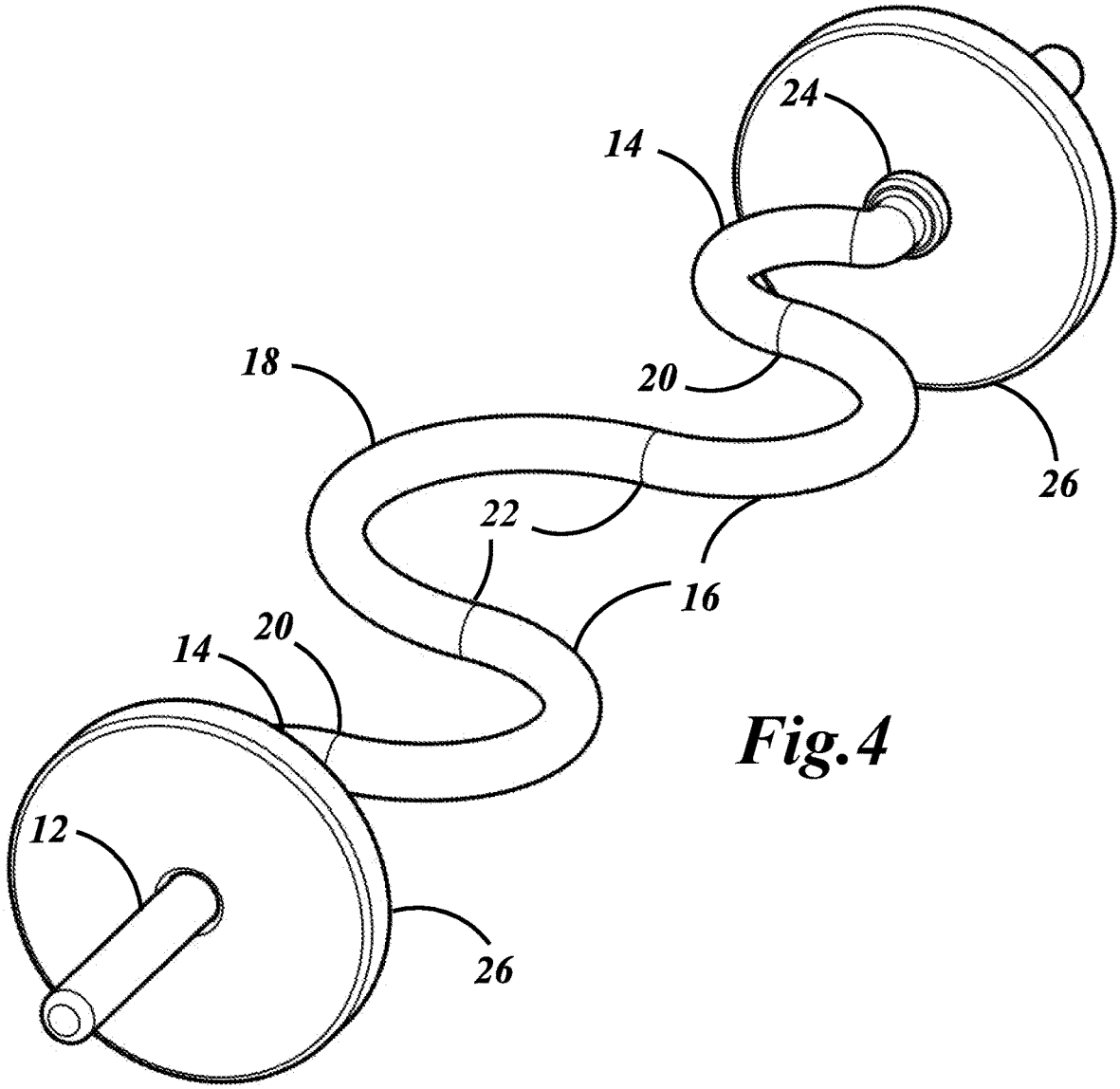
FIG. 4 is a perspective view of the exercise bar of FIG. 1 having weights on the straight ends.

As shown in FIG. 4, the straight ends 12 are configured to hold a plurality of weights 26. A weight abutment zone 24 may be fixed to each of the straight ends 12 to prevent the weights 26 from reaching the outer pair of curved grips 14. Abutments zones 24 may be attached to the straight ends 12 before or after the forming process of the curved sections takes place. Clips (not shown) may be added to the straight ends 12 to secure the weights 26 against the abutment zone 24.

Figure 5:
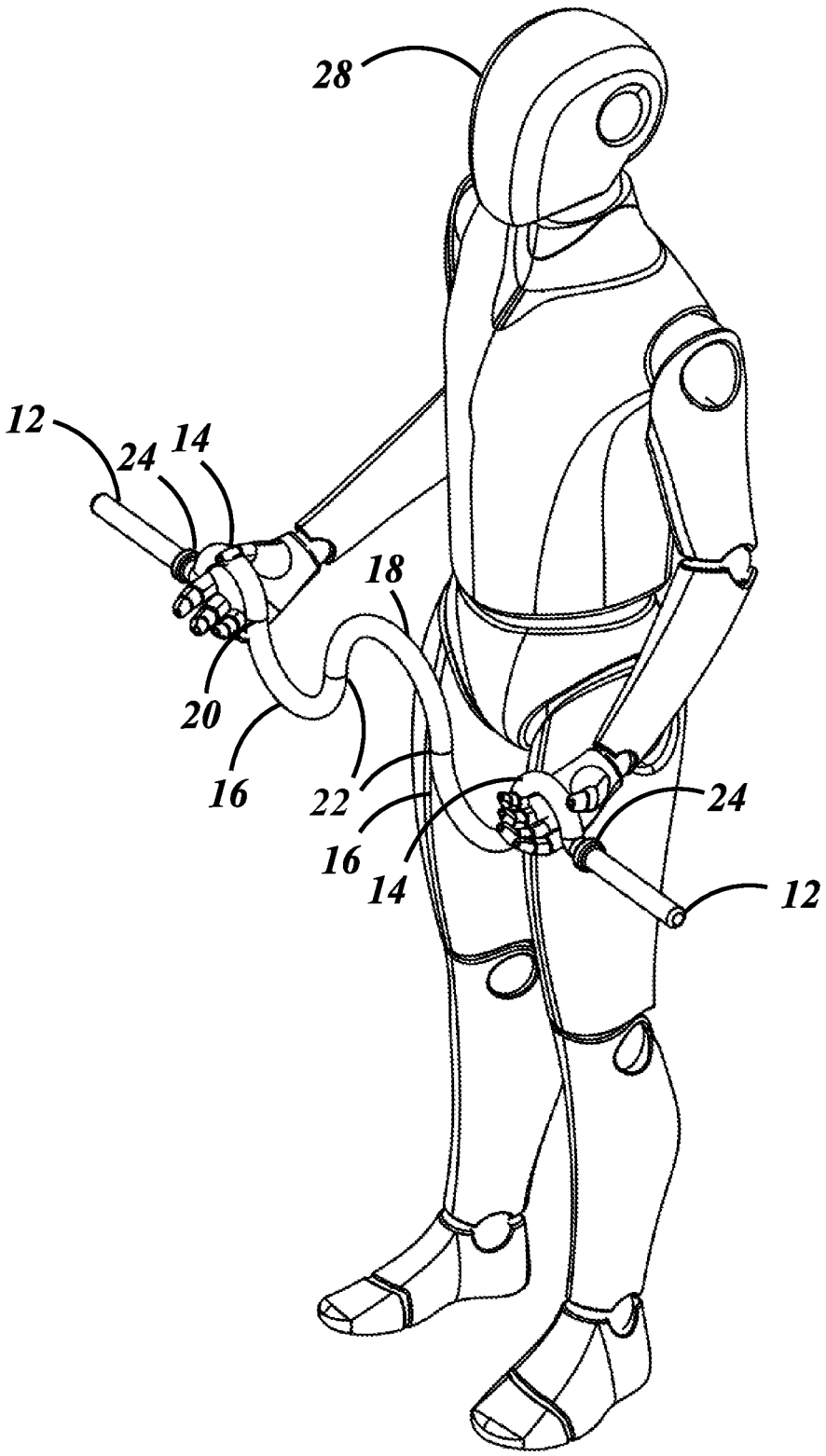
FIG. 5 is a perspective view of a user gripping the outer pair of curved grips of the exercise bar of FIG. 1.
Figure 6:
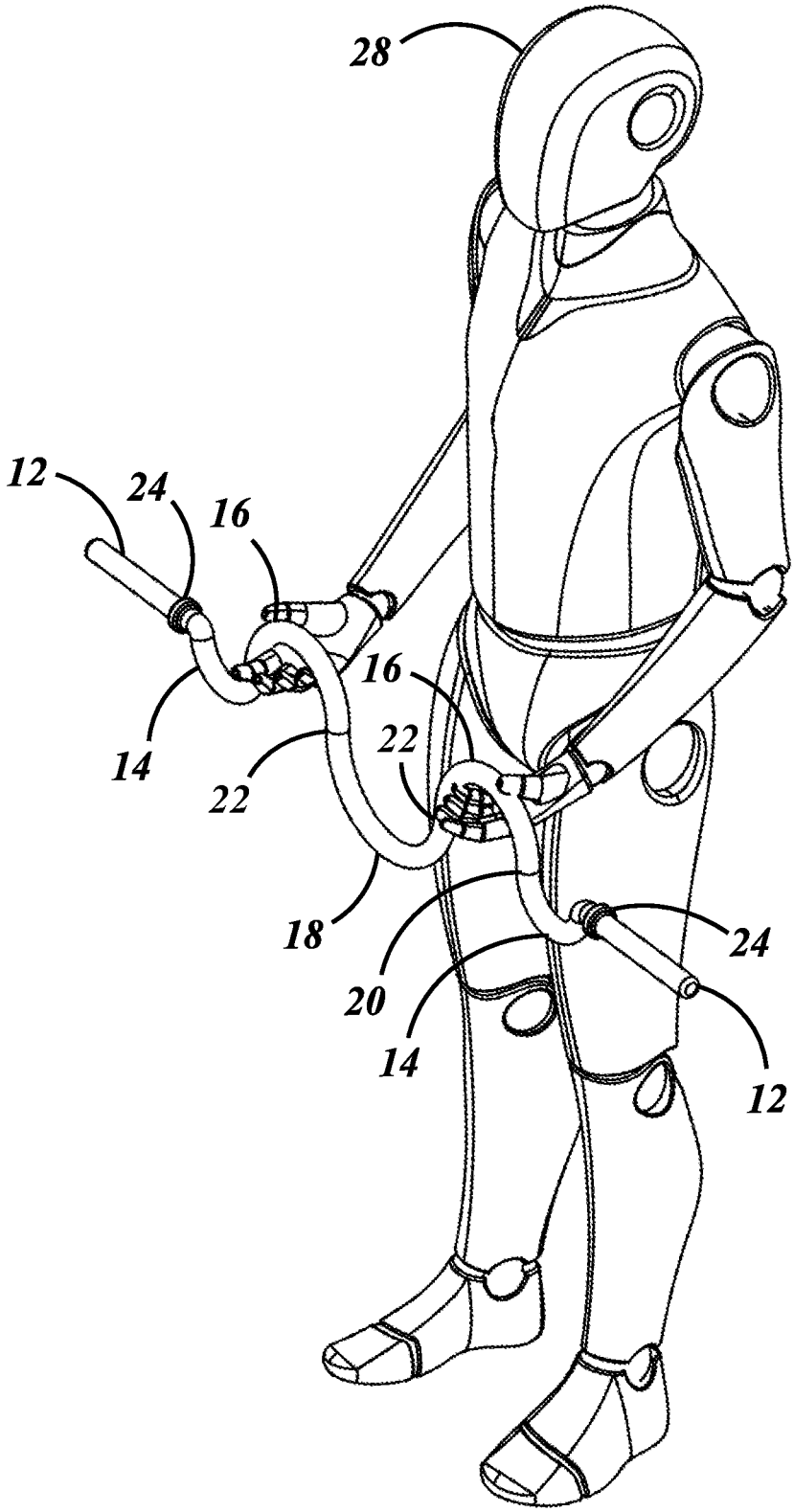
FIG. 6 is a perspective view of a user gripping the inner pair of curved grips of the exercise bar of FIG. 1.

The outer and inner pairs of curved grips 14 and 16 can be grasped throughout a large range of angles. As shown in FIGS. 5 and 6, a user 28 may grip the exercise bar 10 at the peaks of the inner and outer pairs of curved grips 14 and 16 that is generally perpendicular to the Axis A:A. As the user 28 moves their hands inwardly along the outer or inner pair of curved grips 14 or 16, the angle of that they grip the exercise bar 10 increases until the first or second pair of parallel grips 20 or 22 are reached. The orientation of the outer and inner pairs of curved grips 14 and 16 and the central curved section 18 allows for a 90-degree range of gripping angles, which enable a user 28 to target specific heads of the biceps and triceps and specific muscle groups in the shoulders, chest, and back.

Figure 7:
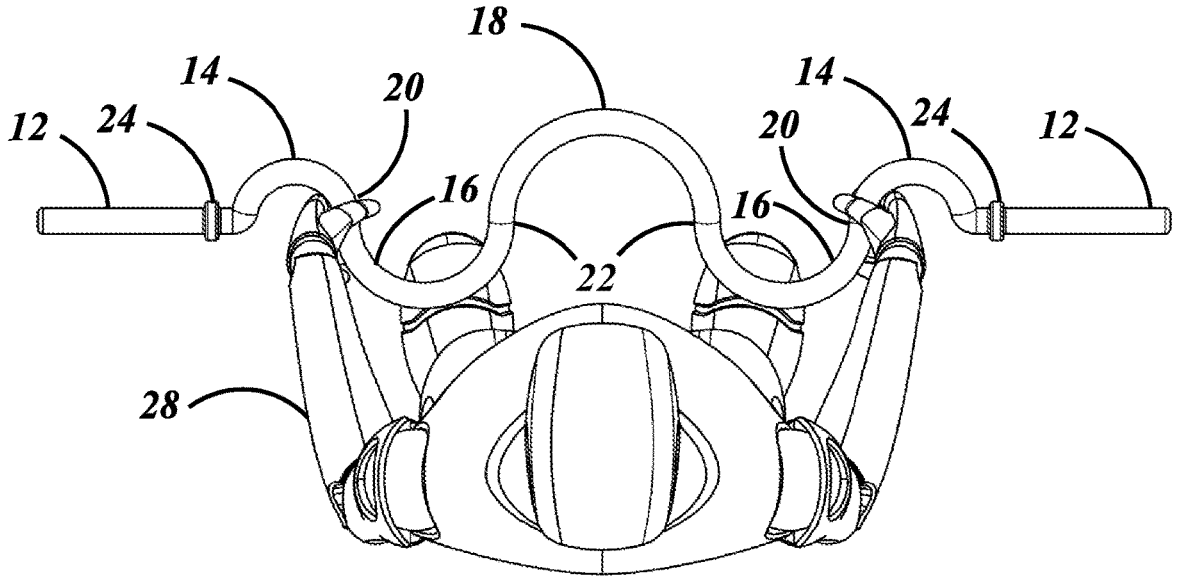
FIG. 7 is a top view of a user gripping the first pair of parallel grips of the exercise bar of FIG. 1.
Figure 8:
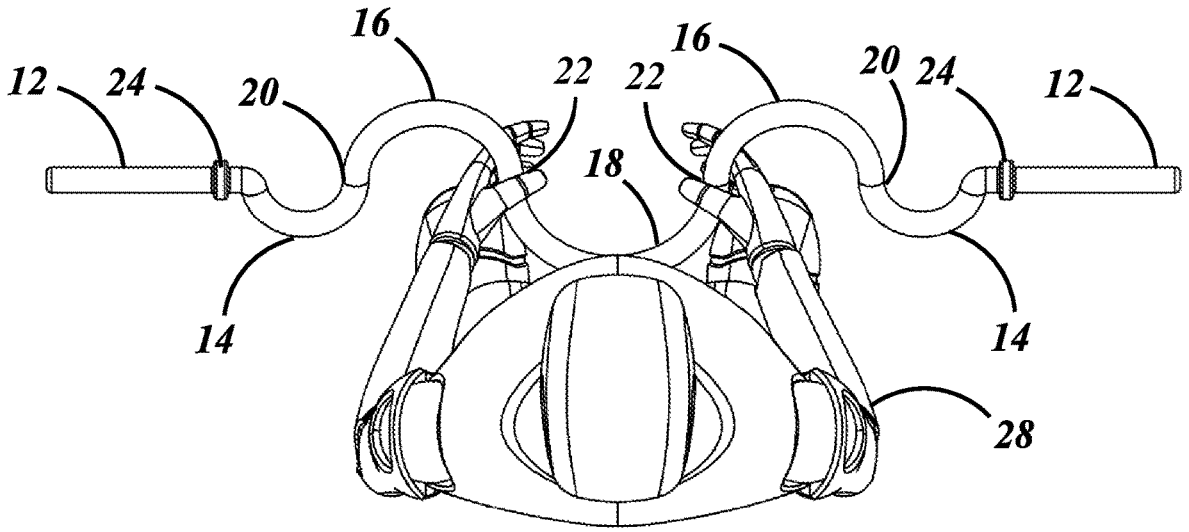
FIG. 8 is a top view of a user gripping the second pair of parallel grips of the exercise bar of FIG. 1.

When utilizing the first and second pair of parallel grips 20, 22, the user 28 assumes a gripping position that is generally perpendicular to the axis A:A as shown in FIGS. 7 and 8. The perpendicular grip of the first and second pair of parallel grips 20, 22 is known as a hammer grip, which helps to target certain muscles in the biceps, triceps, chest, back, and shoulders when used in different exercises. The number and orientation of gripping positions allows this exercise bar 10 to be utilized for a wider variety of exercises than are possible with traditional bars.

Figure 9:
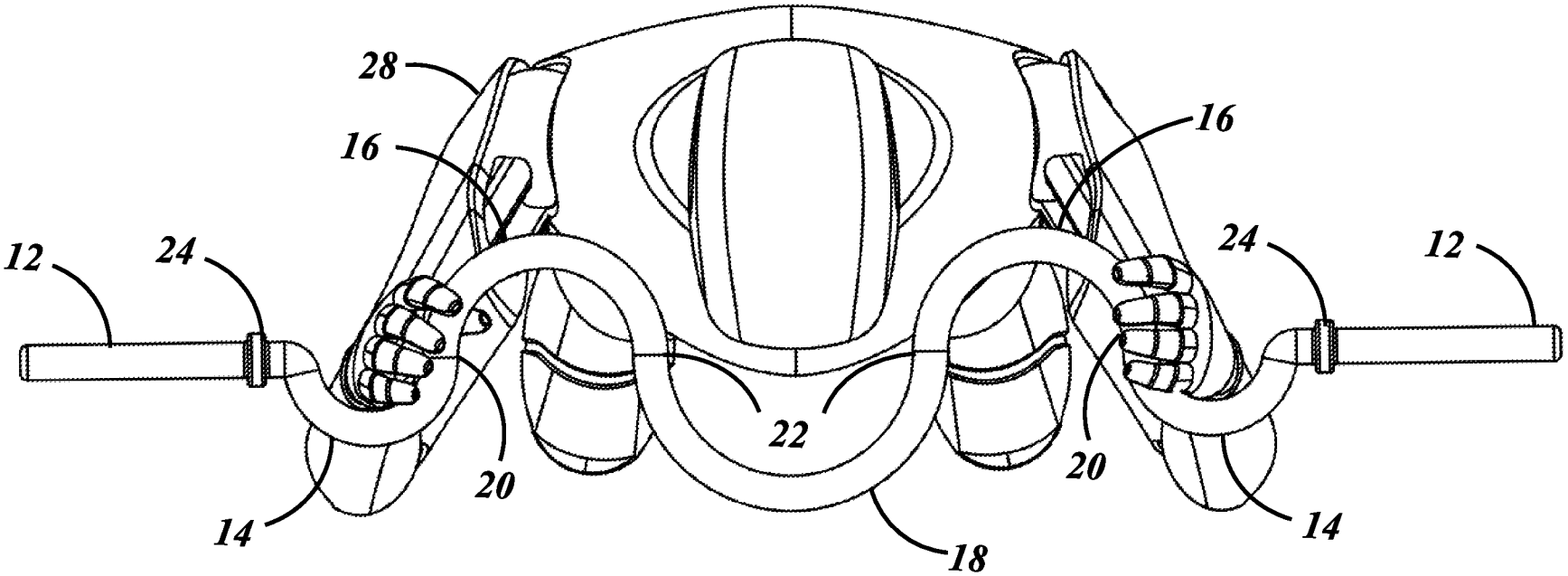
FIG. 9 is a top view of a user gripping the first pair of parallel grips of the exercise bar of FIG. 1 for a shoulder press exercise.

In the preferred embodiment, the central curved section 18 is the largest curve with a radius of approximately 4.5 inches. The inner pair of curved grips 16 have a radius of approximately 3.5 inches and are spaced approximately at shoulder width. The outer pair of curved grips 14 has a radius of 2.5 inches. The overall length of the exercise bar 10 is preferably 44 inches. The size and spacing of the curved sections 14, 16, and 18 may be altered to accommodate different grip positions, grip spacing, or different sized users. As shown in FIG. 9, the central curved section 18 may be sized to accommodate a user's head to allow for an improved range of motion during certain shoulder exercises. The curved central section 18 allows to perform a shoulder press exercise without altering their range of movement or adjusting their head to avoid contact with the bar. The curved central section 18 allows a user 28 to bear the exercise bar 10 on their shoulders and upper back without the exercise bar 10 contacting their neck.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

The invention claimed is:

1. An exercise bar, comprising:

axially aligned straight ends for holding weights;

an outer pair of curved grips extending inward from said straight ends;

an inner pair of curved grips extending inward from said outer pair of curved grips such that a first pair of parallel grips are formed that are generally perpendicular to said straight ends; and a central curved section joining said inner pair of curved grips such that a second pair of parallel grips are formed that are generally perpendicular to said straight ends.

2. The exercise bar of claim 1 further comprising a weight abutment zone between said straight ends and said outer pair of curved grips.

3. The exercise bar of claim 1 further comprising knurling on said outer pair of curved grips, said inner pair of curved grips, said first pair of parallel grips, and said second pair of parallel grips.

4. The exercise bar of claim 1 further comprising rubber sleeves covering said outer pair of curved grips, said inner pair of curved grips, said first pair of parallel grips, and said second pair of parallel grips.

5. The exercise bar of claim 1 wherein said outer curved grips are oriented above said axially aligned straight ends.

6. The exercise bar of claim 1 wherein said inner pair of curved grips are below said axially aligned straight ends.

7. The exercise bar of claim 1 wherein said central curved section is above said axially aligned straight ends.

8. The exercise bar of claim 1 wherein said outer pair of curved grips and said central curved section are both above said axially aligned straight ends.

9. The exercise bar of claim 1 wherein said inner pair of curved grips are oriented opposite from said outer curved grips and said central curved section.

10. The exercise bar of claim 1 wherein said exercise bar is formed from a single continuous section.

11. The exercise bar of claim 1 wherein said central curved section is sized to accommodate a user's head.

12. The exercise bar of claim 1 wherein said inner pair of curved grips is spaced at a shoulder width.

* * * * *